United States Patent [19]

Eaton et al.

[11] 4,386,112

[45] May 31, 1983

[54] CO-SPRAY ABRASIVE COATING

[75] Inventors: Harry E. Eaton, Woodstock; Richard C. Novak, Glastonbury, both of Conn.

[73] Assignee: United Technologies Corporation, Hartford, Conn.

[21] Appl. No.: 317,685

[22] Filed: Nov. 2, 1981

[51] Int. Cl.[3] ..... B05D 1/10

[52] U.S. Cl. ..... 427/34; 427/422; 427/423

[58] Field of Search ..... 427/34, 196, 201, 422, 427/423, 426, 427; 219/121 PL, 76.16

[56] References Cited

U.S. PATENT DOCUMENTS

| | | | |
|---|---|---|---|
| 3,020,182 | 2/1962 | Daniels | 427/423 |
| 3,283,117 | 11/1966 | Holmes et al. | 427/34 |
| 3,339,933 | 9/1967 | Foster | 277/53 |
| 3,719,519 | 3/1973 | Perugini | 117/71 |
| 3,751,295 | 8/1973 | Blumenthal et al. | 427/34 |
| 3,900,639 | 8/1975 | Lauterbach | 427/34 |
| 3,911,891 | 10/1975 | Dowell | 427/34 |
| 3,922,207 | 11/1975 | Lowrey | 204/16 |
| 3,927,223 | 12/1975 | Takabatake et al. | 427/34 |
| 3,947,607 | 3/1976 | Gazzard | 427/34 |
| 3,977,660 | 8/1976 | Nakahira | 266/265 |
| 4,077,637 | 3/1978 | Hyde et al. | 277/235 |
| 4,086,391 | 4/1978 | Giggins et al. | 428/679 |
| 4,148,494 | 4/1979 | Zelaby et al. | 277/53 |
| 4,163,071 | 7/1979 | Weatherly et al. | 427/34 |
| 4,169,020 | 9/1979 | Stalker | 204/10 |
| 4,224,356 | 9/1980 | Singer | 427/34 |

FOREIGN PATENT DOCUMENTS

| | | | |
|---|---|---|---|
| 946230 | 4/1974 | Canada . | |
| 2615022 | 7/1977 | Fed. Rep. of Germany | 427/34 |
| 774622 | 12/1934 | France | 427/426 |
| 1003118 | 9/1965 | United Kingdom . | |
| 1103679 | 2/1968 | United Kingdom . | |

*Primary Examiner*—Shrive P. Beck

*Attorney, Agent, or Firm*—Robert C. Walker

[57] ABSTRACT

Methods for applying grit containing abrasive coatings by plasma spray techniques are disclosed. Various concepts for obtaining good adherability of the coating to an underlying substrate and for maintaining angularity of the grit particles are discussed. The concepts employ simultaneous contact of the grit particles with matrix material at the surface of the substrate to be coated. In coating narrow substrates, the substrate is offset from the axis of the plasma stream discharging from the plasma gun.

5 Claims, 9 Drawing Figures

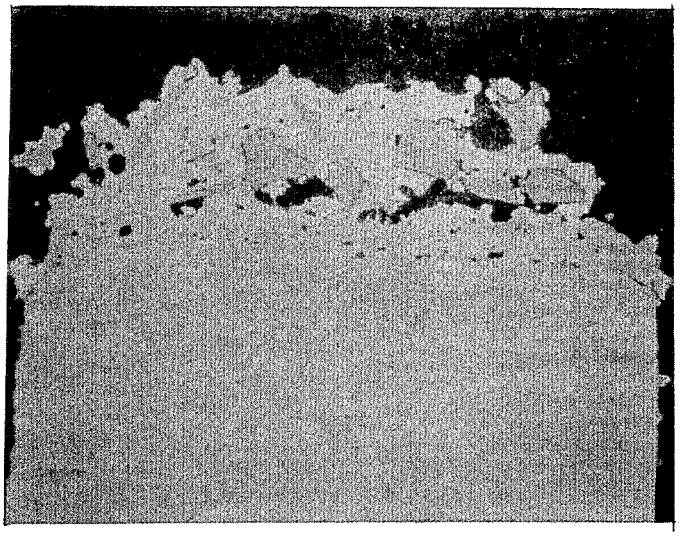
FIG. 8
FIG. 9
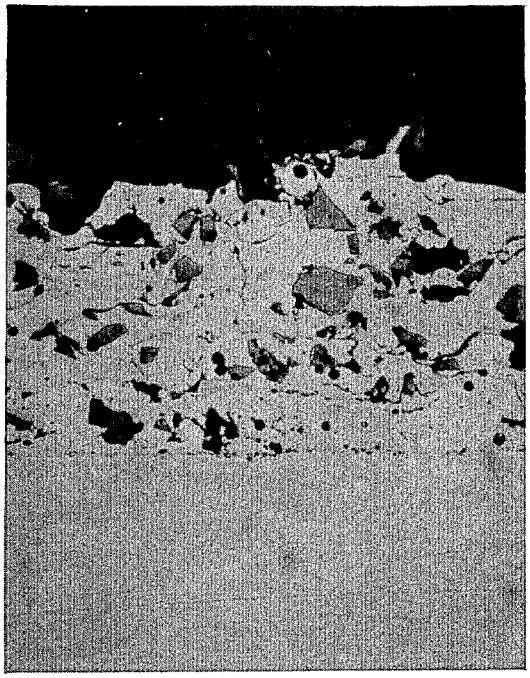

CO-SPRAY ABRASIVE COATING

DESCRIPTION

1. Technical Field

This invention relates to abrasive coatings and more specifically to grit containing coatings applied by plasma spray process techniques.

The concepts were developed in the gas turbine engine field for the application of abrasive coatings to parts in that industry, but have wider applicability to components and structures in other industries as well.

2. Background Art

Grit type materials are used in the gas turbine engine industry to impart abrasive qualities to one of two opposing surfaces which are susceptible to rubbing contact. The avoidance of destructive interference at contact between the two surfaces is sought by causing the abrasive surface to cleanly cut material from the opposing surface until noninterfering movement results.

The above technique is representatively applied at the interstage gas path seals between rotor and stator assemblies. Both inner diameter and outer diameter seals are capable of employing the concept. At the outer diameter air seals the tips of the rotor blades are provided with an abrasive quality such that during rotor excursions of greater relative growth than the circumscribing stator, the rotor blades cut cleanly into the opposing shroud. Once the seals are "run in" a minimum or zero clearance is established at the point of maximum rotor excursion. Subsequent excursions do not wear away additional material. Representative prior art methods of manufacturing abrasive tipped rotor blades are discussed in U.S. Pat. No. 3,922,207 to Lowrey et al entitled "Method for Plating Articles with Particles in a Metal Matrix" and U.S. Pat. No. 4,169,020 to Stalker et al entitled "Method for Making an Improved Gas Seal".

Similarly, abrasive coatings are utilized in other sealing applications, such as at labyrinth seals internally of an engine. U.S. Pat. No. 4,148,494 to Zelahy et al entitled "Rotary Labyrinth Seal Member" is representative of such a construction.

As the desirability of abrasive grit coating in the gas turbine engine industry has increased, scientists and engineers in that industry have sought yet improved structures and deposition techniques, particularly techniques capable of maintaining angularity of the grit particles and good adherence to the surface on which the particles are deposited.

DISCLOSURE OF INVENTION

According to the present invention abrasive grit particles and matrix material for adhering the grit particles to the surface of a substrate are codeposited at the surface of the substrate in a process causing simultaneous incidence of the metal matrix material with abrasive grit at the surface of the substrate.

In accordance with a detailed deposition method a plasma gas stream is generated in a plasma gun, metal matrix particles are injected into a plasma stream, abrasive grit particles are subsequently injected into that stream at the point of incidence of the stream with the surface of the substrate to be coated, and the gun is traversed across the surface of the substrate.

A principal feature of the co-deposition method is the simultaneous incidence of the abrasive grit particles with the heated matrix material carried by the plasma stream at the surface of the substrate to be coated. Powders of metallic matrix material are injected into the plasma stream at a location spaced from the surface to be coated and the grit particles are injected into the plasma stream at a location nearer the substrate to be coated than the point of injection of matrix particles. The abrasive grit particles injected into the stream come into contact with the metal matrix materials at the surface to be coated. In one detailed apparatus the grit injector and the matrix injector are oriented one hundred eighty degrees (180°) apart at the perimeter of the plasma stream.

A principal advantage of the present invention is the capability of depositing economical coatings with good adhereability and angularity of the grit particles. Good adherability is achieved by trapping the grit particles in the molten metal matrix material as the metal matrix material solidifies at the surface of the substrate to be coated. Good angularity of the grit particles is preserved by avoiding prolonged contact of the grit particles with the high temperature portion of the plasma stream. The deposition process has good flexibility in the ability to deposit grit particles of varying size and in the ability to utilize matrix materials having widely varying characteristics. Good abrasive quality of the coating is maintained throughout the application process. Grit particles may be deposited through the full depth of the coating, or merely at the surface by delaying grit injection to one or more subsequent passes over the substrate to be coated. The coating process described is well suited to the refurbishment of coated parts after initial use. The process can be employed to apply abrasive coatings to surfaces of complex geometry.

The foregoing, and other objects, features and advantages of the present invention will become more apparent in the light of the following detailed description of the preferred embodiment thereof as shown in the accompanying drawing.

BRIEF DESCRIPTION OF DRAWING

FIG. 8 is a cross section photograph (100×) of an abrasive coating applied to a rotor blade tip under the Example I parameters; and FIG. 9 is a cross section photograph (200×) of an abrasive coating applied to the knife-edge of a labyrinth type seal under the Example II parameters.

BEST MODE FOR CARRYING OUT THE INVENTION

Figure 1:
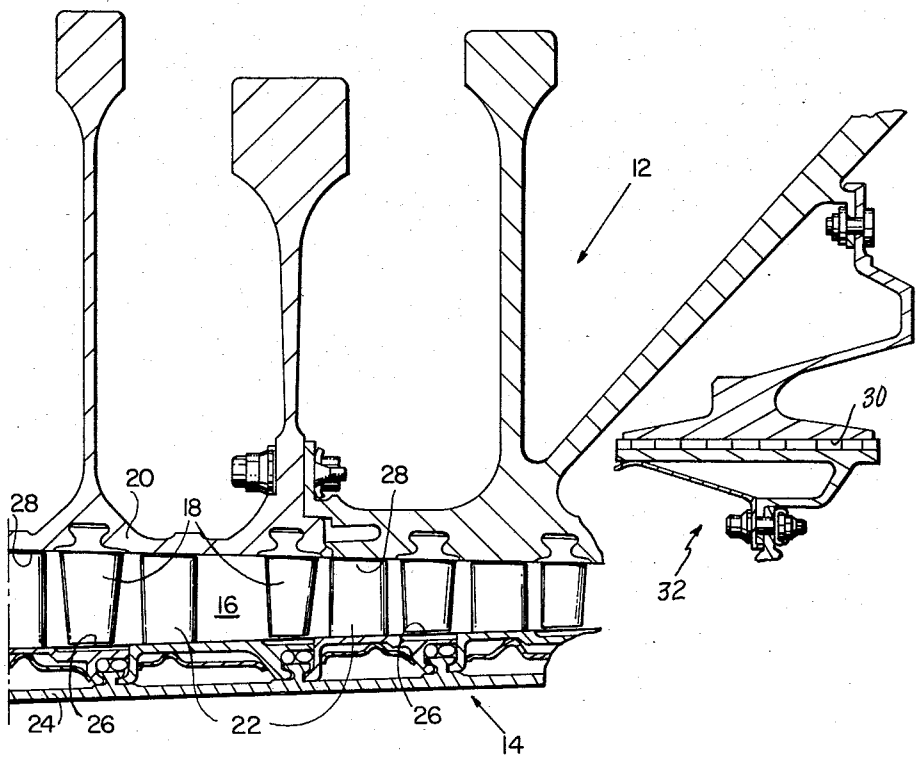
FIG. 1 is a simplified side elevation view of a portion of a gas turbine engine including sections broken away to reveal opposing components of the stator and rotor assemblies.

Coatings applied by the present method have utility in the gas turbine engine industry. FIG. 1 is a simplified cross section illustration of a portion of the compressor section of an engine in that industry. A rotor assembly 12 extends axially through the engine and is encased by a stator assembly 14. A flow path 16 for working medium gases extends axially through the engine. Rows of rotor blades, as represented by the single blades 18, extend outwardly from a rotor drum 20 across the flow path 16. Rows of stator vanes, as represented by the single vanes 22, are cantilevered inwardly from an engine case 24 across the flow path. An outer air seal 26 circumscribes each row of rotor blades 18. An inner air seal 28 is formed by the rotor drum 20 inwardly of each vane row 22. Abrasive coatings are applied, for example, at the interface between the tips of the rotor blades 18 and the outer air seal or at the interface between the tips of the vanes 22 and the inner air seal 28. The elimination of destructive interference at such interfaces upon the occurrence of rotor excursions during transient conditions is sought. Providing an abrasive coating on one of said opposing surfaces wears material cleanly away from the corresponding surface without destroying the structural integrity of either part.

Figure 3:
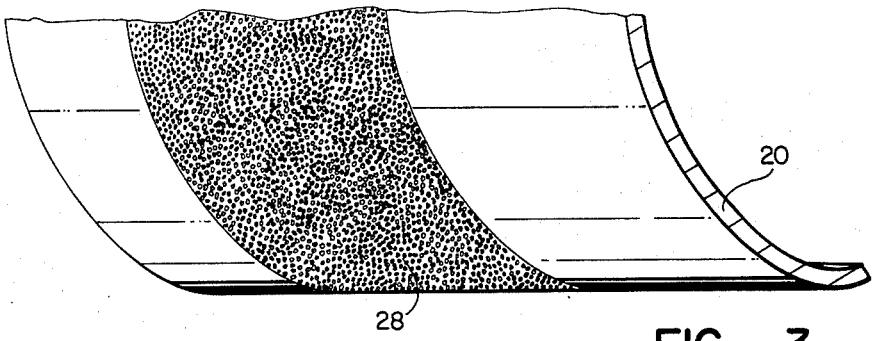
FIG. 3 is a simplified representation of a portion of the rotor assembly drum with abrasive coating adhered thereto.
Figure 2:
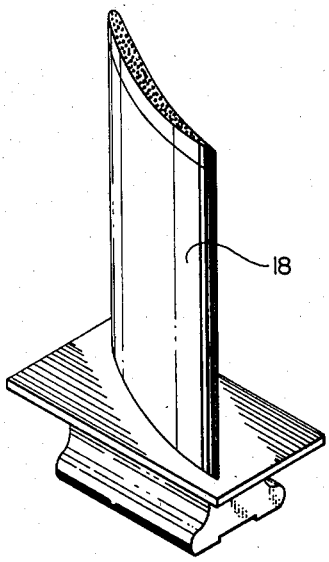
FIG. 2 is a simplified illustration of the tip of a rotor blade with abrasive coating adhered thereto.

The compressor structure of FIG. 1 illustrates components to which abrasive coatings may be applied—tips of the rotor blades 18 and inner air seals 28 on the rotor. Such components and their coatings are illustrated in FIGS. 2 and 3 respectively. Other applications might include the solid land 30 of a wide channel type seal 32 such as that illustrated in FIG. 1 or the knife edge, FIG. 4, of a labyrinth type seal.

In one detailed aspect such abrasive coatings have particular utility when used in conjunction with components fabricated of titanium alloy. The large heat of reaction released on oxidation of such alloys renders the components susceptible to fires upon the occurrence of rubbing interference. An abrasive coating on one of such rubbing components causes material to be cut from the opposing component without generating excessive heat loads.

Figure 5:
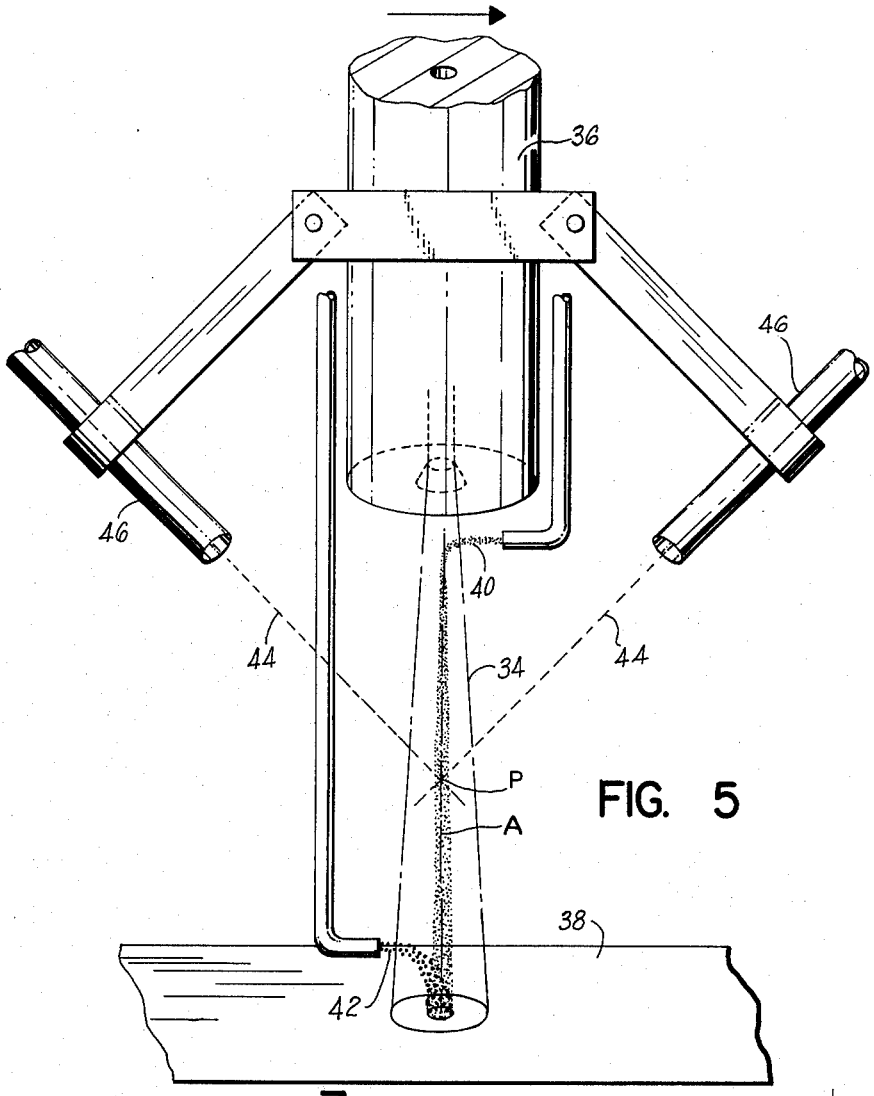
FIG. 5 is a simplified representation of plasma spray apparatus depositing an abrasive coating in accordance with the concepts of the present invention.
Figure 6:
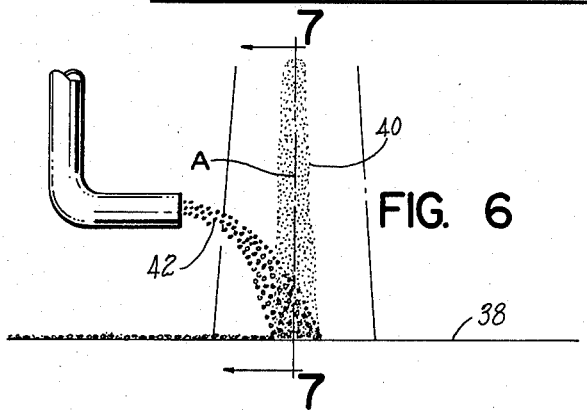
FIG. 6 is an enlarged view illustrating simultaneous impact of the grit particles with the matrix particles at the surface of the substrate being coated.

A method of applying abrasive coatings by the present techniques is illustrated by FIG. 5. A stream 34 of plasma gases is formed within a plasma generator 36 and is discharged toward the surface of the substrate 38 to be coated. Particles 40 of matrix material are injected into the plasma stream remotely from the surface of the substrate and are plasticized or melted within the plasma stream. Particles 42 of grit material are injected into the plasma stream in close proximity to the surface of the substrate. Both the grit particles and the matrix particles are preferably injected parallel to the direction of the motion vector of the gun across the substrate. The mass ratio of matrix material to deposited grit particles may be widely variable. Ratios between 1:1 and 100:1 are typical. In at least one detailed method, the matrix particles and the grit particles are injected into the plasma stream at relative locations around the perimeter of the plasma stream which are approximately one hundred eighty degrees (180°) apart. In a further detailed method the matrix particles and the grit particles are injected into the plasma stream from directions substantially perpendicular to the axis A of the plasma stream.

The plasma sprayed coating is cooled at the substrate by cooling jets 44 which emanate from nozzles 46 on opposing sides of the plasma gun. The jets 44 are directed in the illustration so as to intersect at a point P above the surface of the substrate.

The spacings of the matrix particle injection point and of the grit particle injection point from the surface of the substrate are important factors to successful application of the abrasive coating. In principle, the matrix particle injection point must be spaced at a sufficient distance from the substrate to enable softening or melting of the particles in the plasma stream. The grit particle injection point must be sufficiently close to the substrate so as to enable entrapment of the grit in the matrix material at the surface of the substrate without melting of the angular cutting edges on the grit. Additionally, spacing the grit particle injection point close to the substrate minimizes acceleration of the grit particles by the plasma stream, and reduces the tendency of the grit to bounce from the substrate before the grit becomes entrapped in the matrix. Actual spacings of the grit and matrix injection points from the substrate will depend upon the composition and particle size of the materials selected.

Another important aspect considered in location of the grit injection point is the effect of location on the incidence between the matrix particles and the grit particles. The optimum point of incidence occurs at the surface of the substrate. Simultaneous contact of the grit particles with matrix particles and the surface of the substrate is desired. Incidence of the grit particles with the matrix material above the substrate surface results in premature cooling of the matrix and low retention ratio of the grit particles by the matrix since only molten or plasticized matrix material will deposit at the surface. Additionally, prolonged contact of the grit particles with the high temperature plasma gas may reduce the angularity of the grit particle cutting edges.

Another factor in achieving high probability of grit particle entrapment is the injection angle of the grits into the plasma stream. The optimum angle is as close to ninety degrees (90°) as is practicable such that the dwell time of the particles in proximity to the substrate is maximized. Particles injected in the downstream direction have an increased tendency to bounce off the substrate; particles injected in the upstream direction are ultimately accelerated by the plasma stream and also have a tendency to bounce off of the substrate.

Multiple coating runs have been made with a wide variety of material selections and application parameters. The examples shown below are representative of the most successful runs.

EXAMPLE I

The tip of a compressor rotor blade, such as the blade 18 illustrated in FIG. 2 was coated to a depth on the order of ten thousandths of an inch (0.010 in.) in a single pass of the plasma gun across the blade tip. Plasma spray parameters were as indicated below:

| Plasma Gun - Metco 7M Gun with type G nozzle | |
|---|---|
| Nozzle Distance from Substrate | 2⅜ inches |
| Matrix Injection Point from Substrate | 2 5/16 inches |
| Grit Injection Point from Substrate | 1/16 inch |
| Cooling Jet Crossing Distance from Substrate | ⅜ inch |

-continued

| Plasma Gun - Metco 7M Gun with type G nozzle | |
|---|---|
| Plasma Gun Current | 540 amps |
| Plasma Gun Voltage | 70 volts |
| Relative Velocity between Gun and Substrate | 3 feet per second |
| Primary Plasma Arc Gas | Nitrogen<br>130 cu. ft./hr.<br>50 psi |
| Secondary Plasma Arc Gas | Hydrogen<br>approx. 10<br>cu. ft./hr.<br>50 psi |
| Matrix Material | Metco 443 (Nickel Chromium Alloy plus Aluminum)<br>particle size<br>(−150/+38 microns)<br>flow rate<br>(25 grams/min.) |
| Grit Material | Silicon Carbide<br>particle size<br>(140 grit)<br>flow rate<br>(100 grams/min.) |
| Matrix Carrier Gas | Nitrogen<br>11 cu. ft./hr.<br>50 psi |
| Grit Carrier Gas | Argon<br>15 cu. ft./hr.<br>50 psi |
| Matrix Injector Port | Metco #2 Powder Port |
| Grit Injector Port | ¼ inch O.D. tubing |
| Substrate Material | Titanium Alloy |
| Substrate Preparation | Grit blast/Metco 443 bond coat |
| Substrate Offset from Plasma Spray Axis | 1/16 inch |
| Grit Injector Distance from Plasma Spray Axis | ⅞ inch |
| Direction of Grit Injection | Perpendicular to Plasma Spray Axis |
| Relationship of Matrix and Grit Injectors | 180°. |

EXAMPLE II

Figure 4:
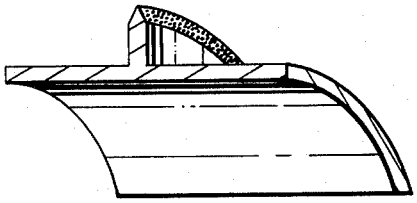
FIG. 4 is a simplified illustration of the knife-edge portion of a labyrinth type seal with abrasive coating adhered thereto.

The knife edge of a labyrinth type seal, such as the knife edge illustrated in FIG. 4, was coated to a depth on the order of ten thousandths of an inch (0.010 in.) in a single pass of the plasma gun across the substrate. Plasma spray parameters were as indicated below:

| Plasma Gun - Metco 7M Gun with type G nozzle | |
|---|---|
| Nozzle Distance from Substrate | 2¼ inches |
| Matrix Injection Point from Substrate | 2 3/16 inches |
| Grit Injection Point from Substrate | ¼ inch |
| Cooling Jet Crossing Distance from Substrate | 0 inch |
| Plasma Gun Current | 480 amps |
| Plasma Gun Voltage | 65 volts |
| Relative Velocity between Gun and Substrate | 5 feet per second |
| Primary Plasma Arc Gas | Nitrogen<br>100 cu. ft./hr.<br>50 psi |
| Secondary Plasma Arc Gas | Hydrogen<br>approx. 10<br>cu. ft./hr.<br>50 psi |
| Matrix Material | Metco 443 (Nickel Chromium Alloy plus Aluminum)<br>particle size<br>(−150/+38 microns)<br>flow rate<br>(25 grams/min.) |
| Grit Material | Silicon Carbide<br>320 grit |
| Matrix Carrier Gas | Nitrogen<br>11 cu. ft./hr.<br>50 psi |
| Grit Carrier Gas | Argon<br>15 cu. ft./hr.<br>50 psi |
| Matrix Injector Port | Metco #2 Powder Port |
| Grit Injector Port | 3/6 inch O.D. Tubing |
| Substrate Material | Titanium Alloy |
| Substrate Preparation | Grit blast/Metco 443 bond coat |
| Substrate Offset from Plasma Spray Axis | 1/16 inch |
| Grit Injector Distance from Plasma Spray Axis | ⅞ inch |
| Direction of Grit Injector | Perpendicular to Plasma Spray Axis |
| Relationship of Matrix and Grit Injectors | 180°. |

Figure 7:
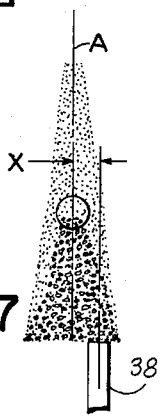
FIG. 7 is a sectional view taken along the line 7—7 of FIG. 6.

The FIG. 7 sectional view illustrates an important concept in the coating of very narrow substrates, particularly compressor blade tips which may be coated in accordance with the Example I parameters or knife edges which may be coated in accordance with the Example II parameters. Typical compressor blade tips may be as narrow as forty thousandths of an inch (0.040 inch); typical knife edges are tapered to a width on the order of ten thousandths of an inch (0.010 inch). Note that the narrow substrate 38 to be coated in FIG. 7 is offset a distance X from the axis A of the plasma stream. In spraying abrasive materials it has been empirically discovered that a highly erosive zone precisely at the axis A of the plasma stream inhibits the buildup of coating material in that region. Offsetting the substrate from the erosive zone at the axis greatly increases the rate at which entrapped grit particles build up on the substrate.

Although the invention has been shown and described with respect to preferred embodiments thereof, it should be understood by those skilled in the art that various changes and omissions in the form and detail thereof may be made therein without departing from the spirit and the scope of the invention.

We claim:

1. A method utilizing a plasma spray gun for depositing an abrasive grit coating on a substrate, including the steps of:

generating a high temperature plasma stream;

injecting particles of matrix material into the plasma stream;

injecting particles of abrasive grit into the plasma stream at a location downstream of the location at which said particles of matrix material are injected, in a direction approximately one hundred eighty degrees (180°) apart at the circumference of the plasma stream from the direction of injection of the matrix material particles, and at a distance from the substrate to be coated such that the matrix particles and the grit particles come into simultaneous contact with the surface of the substrate to be coated and with each other; and traversing the plasma spray gun across the substrate to be coated.

2. The method according to claim 1 wherein the direction of injection of the matrix particles and the direction of injection of the grit particles are parallel to the motion vector of the gun across the substrate, the direction of grit particle injection being in the direction of the motion vector of the gun.

3. The method according to claim 1 or 2 wherein said matrix particles and said grit particles are injected into the plasma stream from a direction substantially perpendicular to the direction of travel of the plasma stream.

4. The method according to claim 1 or 2 where the mass ratio of molten matrix material to depositing grit particles is within the approximate range of 1:1 to 100:1.

5. A method for applying a grit containing coating by plasma spray techniques to a narrow substrate wherein the improvement comprises:

offsetting the narrow substrate from the axis of the plasma spray stream during application of the coating to avoid the erosive zone at the axis of the spray.

* * * * *